United States Patent [19]

Erlandson

[11] 4,140,241

[45] Feb. 20, 1979

[54] BOTTOM END TAPE SEAL

[75] Inventor: Paul M. Erlandson, Palos Park, Ill.

[73] Assignee: The Continental Group, Inc., New York, N.Y.

[21] Appl. No.: 870,207

[22] Filed: Jan. 17, 1978

[51] Int. Cl.[2] ..... B65D 41/00

[52] U.S. Cl. ..... 220/359; 229/7 R; 222/541

[58] Field of Search ..... 220/70, 359, 270, 260; 229/7 R; 215/1 C; 222/541

[56] References Cited

U.S. PATENT DOCUMENTS

| | | | |
|---|---|---|---|
| 3,598,270 | 8/1971 | Adomaitis | 215/1 C |
| 3,985,261 | 10/1976 | Kulesa | 220/359 |

*Primary Examiner*—George T. Hall
*Attorney, Agent, or Firm*—Charles E. Brown

[57] ABSTRACT

A two-piece can wherein the can body is of a drawn and wall ironed construction having an integral bottom with the bottom being in the form of a reinforced structure including alternating projecting ribs and recessed areas. The top of the can is closed by a conventional end unit. In use, the bottom becomes the top and the bottom is provided with a dispensing opening which is closed by a sealing tape. There are several embodiments of the end structure with there being different positions for the dispensing opening therein and different relationships of the sealing tape with respect to the end structure.

20 Claims, 6 Drawing Figures

BOTTOM END TAPE SEAL

This invention relates in general to new and useful improvements in container construction, and more particularly to a container of the easy dispensing type.

In accordance with this invention it is proposed to provide a two-piece container wherein the container body has one end formed integrally therewith. Preferably, the container body is formed of metal and is of the drawn and wall ironed type.

Difficulties have been experienced in forming two-piece cans with respect to the bottom structure. In accordance with this invention it is proposed that the bottom structure be of a profile including alternating projecting ribs and recessed areas with the ribs being generally of a petaloid configuration. Such a bottom structure not only permits the necessary reinforcement for stiffness and stability, but also provides an excellent means for effecting dispensing of a liquid product. With respect thereto, attention is directed to the U.S. patent to Adomaitis U.S. Pat. No. 3,598,270, which discloses a plastics material bottle having a petaloid rib configuration for solving a completely different problem.

In accordance with this invention, the bottom structure is provided with a suitable dispensing opening and this opening is normally sealed by means of a sealing tape. The sealing tape is preferably recessed with respect to the normal seating surface of the bottom structure so as not to interfere with the stability of the container when seated on a supporting surface.

Once a container of the easy dispensing type is opened, a difficulty arises as to what to do with the sealing type. It is first of all desired that the sealing tape remain attached to the container. Secondly, it is necessary that the sealing tape be disposed in an out of the way position relative to the dispensing opening. In accordance with this invention, the inner end of the sealing tape is permanently secured to the container and one of the ribs generally diametrically opposite from the dispensing opening is provided with an inwardly directed bead to define a projection over which the grip portion of the sealing tape, which has a finger receiving opening, may be engaged.

A further feature of a form of the invention is that the general configuration of the area in which the dispensing opening is formed is generally triangular in outline and has beneficially receivable therein a sealing tape which has a major portion thereof also of a generally triangular outline, whereby a maximum number of sealing tapes may be formed from a given amount of material.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
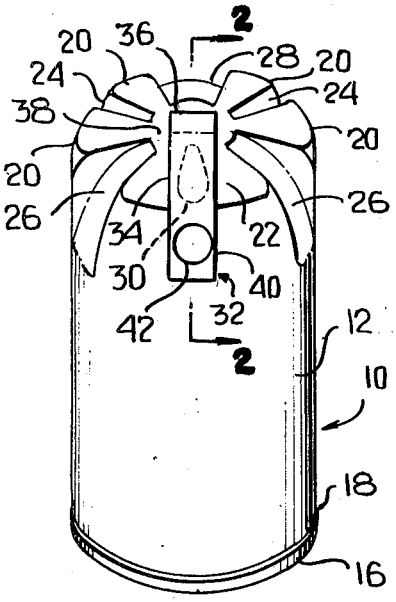
FIG. 1 is a perspective view of a two-piece can formed in accordance with this invention, the can being illustrated in an inverted position.
Figure 2:
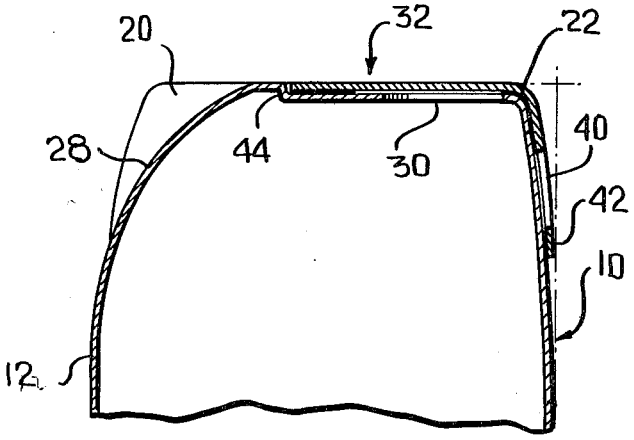
FIG. 2 is an enlarged fragmentary vertical sectional view taken along the line 2—2 of FIG. 1, and shows specifically the recessing of the sealing tape relative to the end structure.

Referring now to the drawings in detail, it will be seen that there is illustrated in FIGS. 1 and 2 a two-piece can formed in accordance with this invention, the can being generally identified by the numeral 10. Although it is envisaged that the can 10 may be formed of other materials, in its preferred embodiment the can 10 is preferably formed entirely of metal. The can 10 includes a can body 12 having an integral bottom structure, generally identified by the numeral 14. A conventional end unit 16 closes the other end of the body 12, the end unit being secured to the body by means of a conventional seam 18.

It is to be understood that the body 12 and integral end structure 14 will be formed from a suitable blank (not shown) by a drawing and wall ironing method which is conventional, after which the bottom structure 14 will be configured by means of suitable cooperating internal and external dies. The manner in which the container is formed does not form a part of this invention, and therefore will not be disclosed in detail here.

It will be seen that the end structure 14 is of a profile including alternating projecting ribs and recessed areas. In the illustrated embodiment, there are four ribs 20 of similar configuration and a fifth rib 22 which is of a greater circumferential extent than the ribs 20. The rib 22 is centered relative to the ribs 20.

Adjacent ribs 20 are separated from one another by recessed areas 24 while the ribs 20 adjacent the rib 22 are separated therefrom by recessed areas 26. Further, diametrically opposite the rib 22 is a recessed area 28.

It is to be understood that all of the ribs 20, 22 have supporting surfaces which lie in a common plane so that the container 10 may be readily seated on the bottom or end structure 14 in a stable condition. Further, the configuration of the ribs 20, 22 sufficiently reinforces the bottom of the container against deformation, such as ballooning, due to internal pressures within the container when beverages, such as beer and soft drinks, are packaged therein.

In accordance with this invention, the container or can 10 is of the easy dispensing type and has formed in the flat surface of the rib 22 a dispensing opening 30. The dispensing opening 30 is preferably of a teardrop shape so as to facilitate pouring or drinking directly from the can. The dispensing opening 30 is closed by means of a sealing tape generally identified by the numeral 32.

The sealing tape 32 has an intermediate portion 34 which overlies the rib 32 in the area of the opening 30 and is detachably bonded to the rib 22 normally to seal the opening 30 against the pressures within the can.

The sealing tape 32 also has an inner end portion 36 which is permanently bonded to the bottom structure 14. It is to be noted that the inner end portion 36 overlies a raised central area 38 of the end structure 14, which central area 38 joins together the ribs 20, 22.

The sealing tape 32 further includes an outer end portion 40 which is in the form of a grip portion and has formed therein a finger receiving opening 42.

In order that the sealing tape 32 will not interfere with the seating stability of the end structure 14, the sealing tape 32 is seated within a shallow recess 44, best illustrated in FIG. 2. It will be seen that the recess 44 extends diametrically across the end surface of the rib 22 and into the central portion 38. It will also be seen that the outer end portion 40 of the sealing tape extends radially outwardly of the groove 44 and alongside the can body 12 for ease of gripping.

Figure 3:
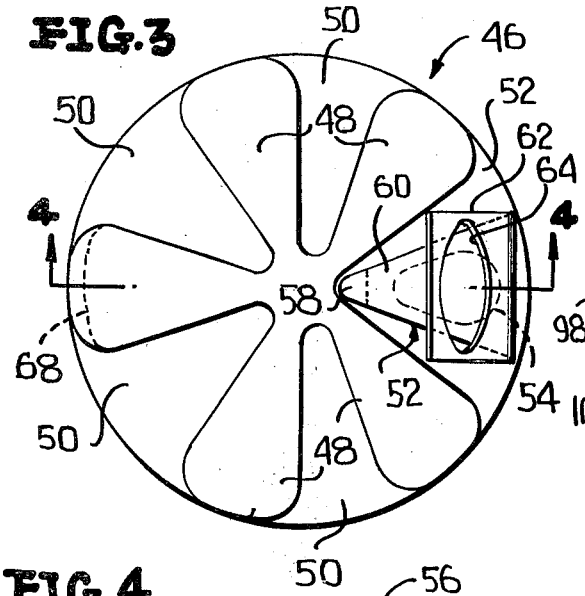
FIG. 3 is a plan view of a modified form of two-piece can with the bottom thereof disposed uppermost.
Figure 4:
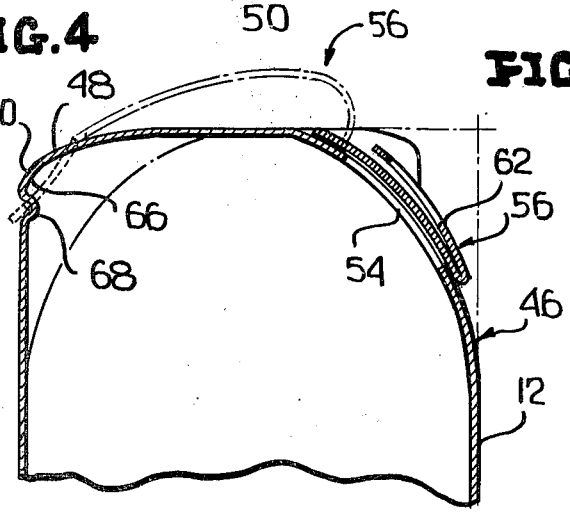
FIG. 4 is a fragmentary vertical sectional view taken generally along the line 4—4 of FIG. 3, and shows the specific relationship of the sealing tape to the end structure, the sealing tape being shown in phantom lines in its opened and retained position.

Reference is now made to FIGS. 3 and 4 wherein the can body 12 is provided with a modified end or bottom structure generally identified by the numeral 46. The end structure 46 is also of a profile including alternating projecting ribs and recessed areas.

The end structure 46, as best shown in FIG. 3, includes a plurality of ribs 48 of like configuration. The ribs 48 are separated by recessed areas 50 and a recessed area 52. The recessed area 52 is specially designated in view of the relationship thereof with respect to the dispensing feature of the end structure 46.

In accordance with the invention, the recessed area has formed in the bottom surface thereof a dispensing opening 54 which is of a teardrop shape. The dispensing opening 54 is normally sealed by means of a sealing tape 56. It is to be noted from FIG. 4 that the sealing tape 56 is totally recessed within the recessed area 52.

The sealing tape 56 includes an inner end portion 58 which is permanently bonded to the end structure 46 to prevent removal of the sealing tape 56 therefrom. The sealing tape 56 also has an intermediate portion 60 which generally overlies the dispensing opening 54 and is removably bonded to the area of the recessed area 52 surrounding the dispensing opening 54.

The sealing tape 56 further includes an outer end portion 62 which is in the form of a grip portion. The grip portion 62 includes a finger receiving opening 64.

It is to be noted that one of the ribs 48 is disposed diametrically opposite the dispensing opening 54. As is best shown in FIG. 4, this rib 48 has an outer shoulder portion 66 which has formed therein a recessed bead 68 defining a projection 70. When the sealing tape 56 is pulled from the position sealing the dispensing opening 64, it may be held in a stored position, as shown in dotted lines in FIG. 4, by engaging the finger receiving opening 64 over the projection 70.

Figure 5:
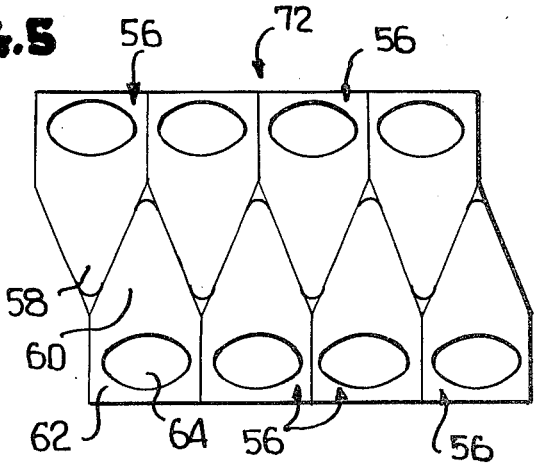
FIG. 5 is a plan view of a strip showing the manner in which sealing tapes to be utilized with the container of FIGS. 3 and 4 may be most economically formed.

At this time it is pointed out that the recessed area 52 is generally triangular in outline and thus the inner end portion 58 and the intermediate portion 60, combined, may also be of a generally triangular outline. As best shown in FIG. 5, two rows of sealing tapes 56 may be cut from a single strip 72 of material in point-to-point offset relation with a minimum of material waste. Further, it is to be noted that the finger receiving opening 64 is beneficially of a generally oval outline elongated transversely of the sealing tape 56 so that a minimum amount of material is required for the grip portion 62.

At this time it is pointed out with reference to FIG. 3 that the recessed area 52 is wider than the recessed areas 50 so as to receive the grip portion 62. It is, however, feasible to have the recessed area 52 narrower and partially to fold the grip portion 62 down therein. On the other hand, the recessed area 52 may be made narrower if the grip portion 62 is made narrower, but this would require the diametrically opposite rib to be narrower so that the finger receiving opening 64 may be engaged thereover.

Figure 6:
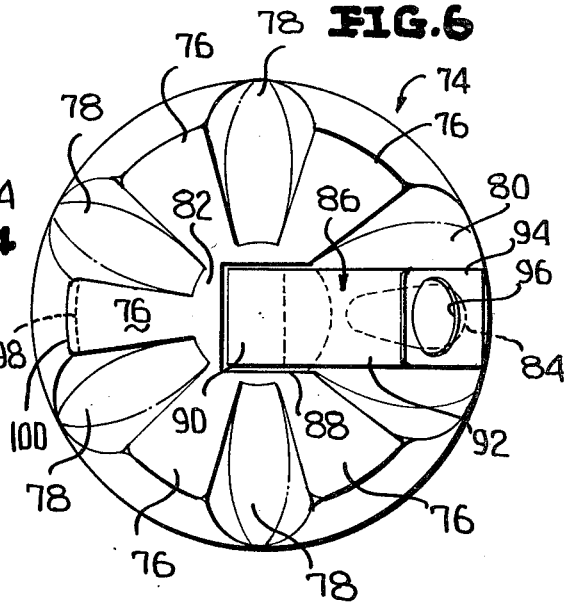
FIG. 6 is a plan view showing the bottom structure of still another modified form of two-piece can.

Referring now to FIG. 6, it will be seen that there is illustrated still another form of bottom or end structure, generally identified by the numeral 74. The end structure 74 is also of a profile including alternating projecting ribs and recessed areas, and generally is the reverse of that of the end structure 14. The end structure 74 includes five circumferentially spaced ribs 76 which may be of similar or identical outline. Generally speaking, the ribs 76 are separated by recessed areas 78 also of generally similar or identical outlines. There is, however, a recessed area 80 which is wider or of a greater circumferential extent than the other recessed areas.

At this time it is also pointed out that the ribs 76 are joined together by a centrally located raised portion 82.

At the bottom surface of the recessed area 80 there is formed a dispensing opening 84 which is also of a generally teardrop outline. The dispensing opening 84 is normally closed by means of a sealing tape generally identified by the numeral 86.

At this time it is pointed out that the central portion 82 has formed therein a shallow recess 88 which opens into the recessed area 80. An inner end portion 90 of the sealing tape 86 is generally seated within the recess 88 and is permanently secured to the end structure 74.

The sealing tape 86 also includes an intermediate portion 92 which overlies and surrounds the dispensing opening 84 and is temporarily sealed relative to the bottom surface of the recessed area 90. The sealing tape 86 further includes an outer end portion 94 which is in the form of a grip portion and has formed therein a finger receiving opening 96.

It will first of all be seen that advantageously all of the sealing tape 86 may be recessed within either the recess 82 or the recessed area 80. Secondly, the sealing tape 86 is disposed diametrically opposite one of the ribs 76 and this one rib may have formed in the outer shoulder portion thereof a recessed inwardly directed bead 98 which defines a projection 100 which may be engaged by the grip portion 94 in the manner illustrated with respect to the end structure of FIGS. 3 and 4.

At this time it is pointed out that the sealing tape 86, in each instance, may be of conventional construction and preferably is in the form of an aluminum foil-plastics material film laminate with the plastics material film opposing the end structure and being suitably bonded to a coating on the end structure or by means of suitable adhesives.

It is to be understood that the bonding of the intermediate portion of each sealing tape to its respective end structure may be controlled so as to withstand the pressure within the associated can while permitting sufficient ease of peeling of the tape from the end structure.

Although only several preferred embodiments of the easy dispensing container have been illustrated and described herein, it is to be understood that minor variations may be made in the container without departing from the spirit and scope of the invention as defined by the appended claims.

I claim:

1. An easy dispensing container comprising a container body having one end closed by an end structure of a profile including alternating projecting ribs and recessed areas, a dispensing opening in said end structure, a sealing tape overlying and closing said dispensing opening, said sealing tape having an intermediate portion detachably secured to said end structure surrounding said dispensing opening, said sealing tape extending radially of said end structure and having an inner end portion disposed radially inwardly of said dispensing opening and permanently secured to said end structure, said sealing tape further having an outer end portion defining grip means.

2. An easy dispensing container in accordance with claim 1 wherein said sealing tape is recessed below the general plane of said ribs whereby when said container is inverted it may be supported on said ribs in a stable state.

3. An easy dispensing container according to claim 1 wherein said dispensing opening is formed in one of said ribs.

4. An easy dispensing container according to claim 1 wherein said dispensing opening is formed in one of said recessed areas.

5. An easy dispensing container according to claim 1 wherein said dispensing opening is formed in one of said ribs, and said one rib has a shallow recess receiving said sealing tape.

6. An easy dispensing container according to claim 1 wherein said dispensing opening is formed in one of said recessed areas, and said sealing tape being disposed entirely within said one recessed area.

7. An easy dispensing container according to claim 1 wherein said dispensing opening is formed in one of said recessed areas, said sealing tape primarily lying in said one recessed area, said end structure including a raised central portion joining together said ribs, and said sealing tape inner end portion overlying said raised central portion.

8. An easy dispensing container according to claim 7 wherein said raised central portion has a shallow recess therein receiving said sealing tape inner end portion.

9. An easy dispensing container according to claim 1 wherein said dispensing opening is formed in one of said recessed areas, said grip means being in the form of a finger receiving opening, one of said ribs being disposed diametrically opposite said one recessed area, said one rib having an outer terminal shoulder remote from said one recessed area, and said shoulder being formed with an inwardly divided bead defining a projection on said shoulder for reception in said finger receiving opening for anchoring said sealing tape in an open position.

10. An easy dispensing container according to claim 1 wherein said grip means is in the form of a finger receiving opening, one of said ribs is disposed generally diametrically opposite said dispensing opening, said one rib having an outer terminal shoulder remote from said one recessed area, and said shoulder being formed with an inwardly divided bead defining a projection on said shoulder for reception in said finger receiving opening for anchoring said sealing tape in an open position.

11. An easy dispensing container according to claim 1 wherein said sealing tape inner end portion and said intermediate portion combined are of a generally triangular outline wherein sealing tapes may be formed from a strip with a minimum of waste.

12. An easy dispensing container according to claim 11 wherein said outer end portion is generally rectangular in outline.

13. An easy dispensing container according to claim 11 wherein said grip means is in the form of a finger receiving opening, said finger receiving opening being generally oval in outline and being elongated transversely of the length of said sealing tape.

14. An easy dispensing container according to claim 4 wherein said one recessed area is generally triangular in outline, and said sealing tape inner end portion and said intermediate portion combined are of a generally triangular outline wherein sealing tapes may be formed from a strip with a minimum of waste.

15. An easy opening dispensing container according to claim 1 wherein said container is formed of metal and is in the form of a drawn and wall ironed can.

16. An easy dispensing container as defined in claim 1 wherein said end structure is the bottom end of the container, and a separately formed end unit forms a top end of said container.

17. An easy dispensing container comprising a container body having an integral bottom end, said bottom end having a projecting base portion and there being a recessed panel portion generally within the confines of said base portion, a dispensing opening formed in said recessed panel portion, a sealing tape overlying and closing said dispensing opening; said sealing tape having an intermediate portion detachably secured to said recessed panel portion surrounding said dispensing opening, one end portion being permanently secured to said recessed panel portion, and a second end portion defining grip means.

18. An easy opening container in accordance with claim 17 wherein said sealing tape is recessed relative to said projecting base portion.

19. An easy opening container in accordance with claim 17 wherein said sealing tape is elongated and extends generally radially of said bottom end, said sealing tape one end being innermost, and said grip portion being reversely folded over said intermediate portion.

20. An easy dispensing container according to claim 19 wherein said sealing tape inner end portion and said intermediate portion combined are of a generally triangular outline wherein sealing tapes may be formed from a strip with a minimum of waste.

* * * * *